US006371029B1

(12) United States Patent
Beal

(10) Patent No.: US 6,371,029 B1
(45) Date of Patent: Apr. 16, 2002

(54) POWDER-BASED DISC FOR GUN AMMUNITION HAVING A PROJECTILE WHICH INCLUDES A FRANGIBLE POWDER-BASED CORE DISPOSED WITHIN A METALLIC JACKET

(75) Inventor: Harold F. Beal, 6277 Sierra Cir., Rockford, TN (US) 37853

(73) Assignee: Harold F. Beal, Rockford, TN (US)

( * ) Notice: Subject to any disclaimer, the term of this patent is extended or adjusted under 35 U.S.C. 154(b) by 0 days.

(21) Appl. No.: 09/491,257

(22) Filed: Jan. 26, 2000

(51) Int. Cl.[7] ..... F42B 12/02; F42B 12/74

(52) U.S. Cl. ..... 102/516; 102/506; 102/507; 102/517; 86/55

(58) Field of Search ..... 102/501, 506–510, 102/514–519, 529, 439; 29/1.2, 1.22, 1.23; 75/228

(56) References Cited

U.S. PATENT DOCUMENTS 2,393,648 A * 1/1946 Martin ..... 102/519
5,399,187 A * 3/1995 Mravic et al. ..... 102/514
5,760,331 A * 6/1998 Lowden et al. ..... 102/516
5,834,683 A * 11/1998 Benvegnu ..... 102/516

FOREIGN PATENT DOCUMENTS

GB 538268 * 7/1941 ..... 102/517
GB 1038702 * 8/1966 ..... 102/501

* cited by examiner

*Primary Examiner*—Harold J. Tudor
(74) *Attorney, Agent, or Firm*—Pitts & Brittian, P.C.

(57) ABSTRACT

A disc for use in the manufacture of gun ammunition and a round of gun ammunition which includes the disc. A preferred disc comprises a mixture of metal powders compressed into self-supporting deformable disc that is incorporated along with a core into a jacket to define the projectile of a round of gun ammunition. The disc is frangible upon the projectile striking a solid or semi-solid target. Preferably the core is likewise frangible. In one embodiment the disc is incorporated into the ogive of a projectile. In another embodiment, a disc may be incorporated into a projectile comprising multiple cores, the disc being disposed between adjacent surfaces of the cores. This latter disc commonly is in addition to the disc which is incorporated into the ogive of the projectile. A round of gun ammunition incorporating a powder-based disc in the projectile thereof is disclosed.

15 Claims, 3 Drawing Sheets

POWDER-BASED DISC FOR GUN AMMUNITION HAVING A PROJECTILE WHICH INCLUDES A FRANGIBLE POWDER-BASED CORE DISPOSED WITHIN A METALLIC JACKET

FIELD OF INVENTION

The present invention relates to components employed in the manufacture of gun ammunition and particularly rifle or pistol ammunition for weapons of 50 caliber or less having rifled barrels.

BACKGROUND OF INVENTION

In all gun ammunition wherein a projectile is propelled from a rifled barrel of a weapon, the projectile spins about its longitudinal axis (about its trajectory) at high speeds of rotation. Consequently, it is of major importance that the density of the projectile be uniform in any given plane taken normal to the longitudinal axis of the projectile so that the projectile does not wobble (nutate) as it is spinning to its target. Wobble of the projectile can adversely affect both the terminal ballistics of the projectile and, more importantly, the accuracy of delivery of the projectile to the target. Severe non-uniformity of the density distribution of the projectile about its longitudinal axis can result in jamming of the projectile within the gun barrel, or in less serious wobble, damage to the lands of the rifling of the gun barrel. Accuracy of delivery of the projectile to a target also dictates that the projectile be of consistent construction, including weight, from projectile to projectile so that a consistent given load of gun powder employed in each round of ammunition will ensure that each round of ammunition functions precisely like each other round of the ammunition. In certain situations, such as sniper fire, it is imperative that the shooter be confident that each round of ammunition will perform precisely like every other round of ammunition for a given weapon for the reason, among others, that the sniper commonly can only get off a single shot to his target. This same situation exists in sport hunting and in competitive shooting.

Of recent vintage is the concept of gun ammunition wherein a round of ammunition includes a projectile that includes a metallic jacket having a core disposed therein, wherein the core is formed from compressed powder or a mixture of powders. Initially, the jacket is in the form of an elongated cup. In this type projectile, a preformed core or plurality of cores are loaded into the jacket through the open end thereof and pressed into conformity with a portion of the interior volume of the jacket. One major concern attending these powder-based projectiles is the accuracy with which the projectile is delivered to a target.

In the art, prior to the advent of powder-based cores, the entire projectile was form ed from lead or other metal. Formation of these projectiles was relatively simple and involved molding of molten metal. This procedure also ensured uniformity of distribution of the density of the lead or other metal throughout the projectile, including uniformity of distribution of the density relative to the longitudinal centerline of the projectile.

In the manufacture of powder-based projectiles, however, there is a major problem associated with attainment of uniformity of the density of the projectile throughout the projectile. For example, the uniformity of the density of a powder-based projectile is affected first in the initial compaction of the powder into a core, second, in the pressing of the core into the jacket to ensure uniform filling of that portion of the interior volume of the jacket which is to be occupied by the core, and third, die forming of the core and jacket for purposes of closing the open end of the jacket (either partially or wholly) and/or defining the geometry of either the trailing end and/or the leading end of the projectile.

Other considerations in the forming of powder-based projectiles include the propensity of the powder to become dislodged within the jacket and thereby diminish the desired uniformity of distribution of the density of the projectile about its longitudinal axis. Another consideration associated with powder-based cores arises when the projectile includes a partially-open leading end of the jacket, particularly where the projectile is provided with an ogive at the leading end of the projectile. In this situation, the formation of the ogive must of necessity take place after the core or cores are loaded into the jacket. Die forming of the ogive is the most commonly used technique for forming the ogive. As the core and jacket are deformed to define the ogive, a small portion of the leading end of the core tends to disintegrate into loose powder particles.

The present inventor has heretofore employed a solid metal disc inserted within the jacket and in overlying relationship to the leading end of the core. This places the disc within the region of the projectile which is formed with an ogive so that the disc is itself deformed, along with a portion of the leading end of the core and a portion of the leading end of the jacket, in the course of die-forming the ogive. This prior disc was of tin or other readily deformable material, preferably a metal. The disc desirably was of substantially uniform density throughout the disc, and especially of uniform density distribution within any given plane normal to the thickness dimension of the disc. These prior discs were formed by a process which included repeated rolling of a sheet of metal, tin, for example, until its thickness was precisely of the desired thickness of the disc. Moreover, this rolling of the sheet of metal has been found to be important for obtaining uniformity of the density distribution of the sheet. Individual discs were heretofore die-punched from the sheet. Such die-punching has been found to, at times, develop a flashing around a perimetral edge of the disc, such flashing tending to be non-uniformly distributed around the edge of the disc. These factors, among others, have presented problems of cost as well as consistency of the density distribution within a jacketed projectile.

It has also been found that solid, particularly metal, discs tend to be driven inwardly of the projectile (along the longitudinal axis of the projectile) when the projectile strikes a solid or semi-solid target, with no disintegration of the disc. In those projectiles where frangibility of the projectile upon its striking a target is desired, this failure of the disc to fully disintegrate detracts from the desired terminal ballistics of the projectile. More importantly, this solid disc becomes a projectile itself and possesses sufficient energy to injure, even kill, an unintended human, for example.

It is therefore an object of the present invention to provide an improved disc for incorporation into a projectile for gun ammunition.

It is another object of the present invention to provide a method for minimizing the non-uniformity of density distribution of a multi-component projectile relative to the longitudinal centerline of the projectile.

Other objects and advantages of the present invention will be recognized from the description contained herein, including the drawings and the claims.

SUMMARY OF THE INVENTION

Figure 1:
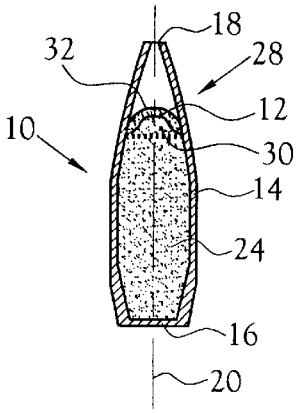
FIG. 1 is a schematic sectional representation of one embodiment of a gun ammunition projectile incorporating a disc of the present invention.

In the present invention, there is provided a disc for use in the manufacture of gun ammunition and a round of gun ammunition which includes the disc. A preferred disc comprises a mixture of metal powders compressed into a self-supporting deformable disc that is incorporated, along with a core, into a jacket to define the projectile of a round of gun ammunition. The disc, and preferably the core, are frangible upon the projectile striking a solid or semi-solid target.

The disc of the present invention is formed from a powder or mixture of powders, preferably metal powders, preferably pressed into a die cavity to form a self-supporting compact. In one embodiment, the powder is tin powder preferably having a particle size distribution wherein there is present within the powder a blend of particle sizes. A preferable blend includes between about 60 and about 70% of powder particles of a size between about 200 and about 325 mesh and between about 20 and about 35%, of powder particles of a size of less than 325 mesh. The remainder of the particles of the blend preferably are of between about 100 mesh and 200 mesh. A precisely measured quantity of the powder blend, according to the present invention, is loaded into a die cavity suitable for forming a disc of precise and uniform diameter, and pressed at room temperature into a self-supporting compact having a uniform desired thickness and density throughout the disc. The selected density of the disc may be chosen to provide a more or less frangible disc or to provide a substantially non-frangible disc depending upon the anticipated target. Similarly, the thickness of the disc may be chosen to provide desired performance of the disc during manufacture of a projectile and/or desired terminal ballistics of the projectile. In any event, the disc is deformable to the extent required to permit the die-forming of an ogive on a projectile which contains the disc adjacent the leading end of a core disposed within the jacket. The limit of deformation of the disc is that deformation which will form the disc into at least a substantially hollow hemispherical geometry without material disintegration of the disc. In this latter respect, the present inventor has found that use of a blend of particle sizes of the powder from which the disc is formed provides for apparent flow within the powder-based disc in much the same manner that solid metal flows when deformed, thereby imparting to the powder-based disc the ability to withstand the required deformation without disintegration of the disc. Of importance in obtaining a deformable powder-based disc is that the tin be substantially free of surface oxidation of the powder particles. Where such surface oxidation is present, it may be driven off by heating the tin powder.

In one embodiment of a projectile, a disc in accordance with the present invention is disposed at the interface between two cores disposed within a jacket. In this embodiment, it has been found that the disc separating the two cores functions in the nature of a pressure distributor with respect to the pressure applied against the cores and disc for causing the cores and disc to conform to that portion of the interior volume of the jacket which it is desired that these elements occupy. Specifically, it has been found that in this combination of cores and disc, those ends of the cores which are adjacent one another do not fracture or disintegrate in their circumferential margins as has been noted when employing solid metal discs or no discs. Whereas it is not known with certainty what mechanism serves to provide this observed result, it appears that the powder-based disc flows to cause portion(s) of the disc to move into and fill any open space(s) between the opposite faces of the disc and those faces of the cores which face the disc, as opposed to disintegration of portions of the disc and/or the cores themselves for filling of such space(s), thereby distributing the pressure applied to the cores and disc substantially over that end of the core which underlies the disc.

DETAILED DESCRIPTION OF INVENTION

Figure 2:
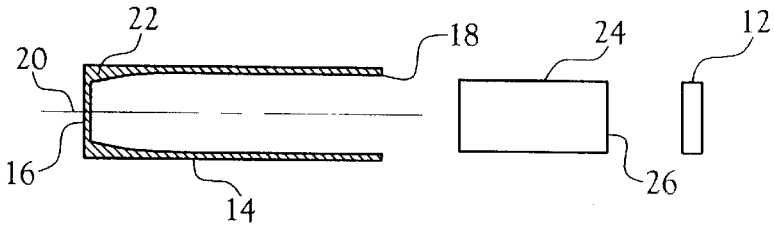
FIG. 2 is an exploded view of the components employed in the formation of a projectile as depicted in FIG. 1.

With reference to FIGS. 1 and 2, one embodiment of a gun ammunition projectile 10 embodying a disc 12 of the present invention includes an elongated cup-shaped jacket 14 having a closed end 16, an open end 18 and a longitudinal centerline 20. Commonly this jacket is formed from a metal which exhibits lubricity properties with respect to the lands of the rifling in the barrel of the gun. Copper or an alloy thereof is most frequently used. Commercially available jackets are deep-drawn from a sheet of the metal and therefore their wall thickness in the region 22 thereof contiguous to the closed end 16 of the jacket 14 is greater than the wall thickness adjacent the open end 18 of the jacket. Most commonly, the wall thickness of the jacket is thickest immediately adjacent the closed end thereof and decreases in thickness to a point approximately one-third of the overall length of the jacket, measured from the closed end of the jacket. The wall thickness of the remaining two-thirds of the jacket is generally of substantially uniform wall thickness. This factor is important when loading the jacket with powder-based cores 24 in that the core must be formed initially to a lesser diameter than the internal diameter of the jacket adjacent the open end of the jacket, but not materially less than the internal diameter of the jacket at the location along the length thereof where the wall thickness, hence the internal diameter of the jacket, ceases to taper outwardly and upwardly from the closed end of the jacket. This maximum permissible diameter of the core permits the core 24 to be pressed into that region 22 of the internal volume of the jacket which is associated with the tapering wall thickness without deleterious destruction of the core, and accompanying loss of density of the core and development of void space(s) within the core.

The projectile 10 depicted in FIG. 1 includes a powder-based disc 12 disposed adjacent the open end 18 of the jacket in overlying relationship to the leading flat end 26 of the core. The disc 12 of FIG. 1 is shown in its deformed geometry after an ogive 28 has been formed at the leading open end 18 of the projectile. It is to be noted that the disc of FIG. 1 has been deformed into a generally hollow substantially hemispherical geometry, with powder from the core filling the hollow 30 of the deformed disc. As depicted, the apex 32 of the deformed disc is disposed adjacent the leading open end 18 of the jacket. Also notably, the disc extends laterally of the longitudinal centerline 20 of the jacket and fully across the internal diameter of the jacket to fully seal the core within the jacket. Further notably, the disc is uniformly deformed which is unexpected of a powder-based disc and is contrary to the tendency of the prior art solid metal discs to deform non-uniformly. This uniformity of deformation is important to the stability of the spinning projectile in its flight to a target as well as the terminal ballistics of the projectile.

Figure 3:
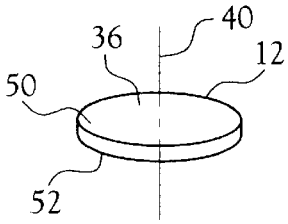
FIG. 3 is a perspective view of a disc in accordance with the present invention.
Figure 4:
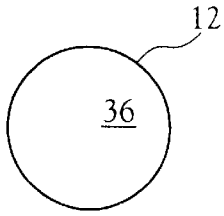
FIG. 4 is a plan view of the disc depicted in FIG. 3.
Figure 5:
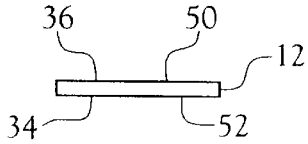
FIG. 5 is a side view of the disc depicted in FIG. 3.

With reference to FIGS. 3–5, a disc 12 of the present invention, when initially formed, comprises a right cylindrical disc having first and second flat planar opposite faces 34 and 36 respectively, which are disposed parallel with one another. Also, when initially formed, the disc is of substantially uniform thickness over its entire area. As will be further noted hereinafter, the disc also is of substantially uniform density throughout the disc and in particular, when initially formed, exhibits uniform density within any plane thereof which is perpendicular to the longitudinal centerline 40 of the disc. In the disc of the present invention, this uniformity of density distribution relative to the centerline of the disc carries forward into the ultimate geometry of the disc in its deformed state within the jacket, even though the overall density of any given plane taken through the deformed disc and perpendicular to the longitudinal centerline of the jacket may vary considerably between planes, the degree of variance depending upon which lanes are being compared.

Figure 13:
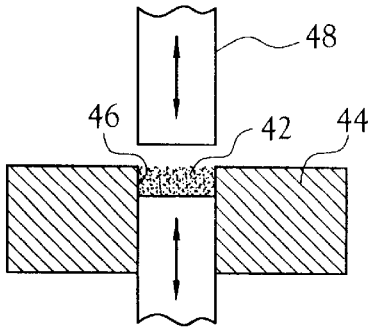
FIG. 13 is a schematic representation of apparatus for pressure-forming a powder-based disc embodying various of the features of the present invention; and, FIG. 14 depicts one embodiment of a round of gun ammunition incorporating therein a powder-based disc feature of the present invention; and, FIG. 15 depicts one embodiment of a round of ammunition incorporating therein a polymeric powder-based disc.

In accordance with one aspect of the present invention, the disc comprises a compressed compact which is pressure-formed from a powder or mixture of powders 42 and 54 (FIG. 13) into a substantially self-supporting compact of substantially uniform thickness and substantially uniform density throughout the compact. FIG. 13 depicts the formation of a disc employing the steps of filling a right cylindrical die 44 cavity with a powder 42, pressing the powder within the die cavity 46 with a punch 48 at a pressure sufficient to compact the powder into a self-supporting compact of uniform thickness and density. The required pressure for forming the compact is in part dependent upon the particular powder employed. In particular, the present inventor has discovered that a metal powder having a blend of particles that provides a particle size distribution which includes a major portion of the particles thereof of a relatively smaller size and a minor portion of the particles of a relatively larger size. In one example, when employing tin powder, a preferable blend includes about 5.6% by wt., of powder particles of a size between about 100 and 200 mesh, about 66.4% by wt., of powder particles of a size between about 200 and about 325 mesh. The remainder of the particles of the blend preferably are of smaller than about 325 mesh. This blend of powder may be pressed within the die 44 at a pressure of between about 12,000 psi and about 16,000 psi to provide a self-supporting compact of right cylindrical geometry with its perimetral edges 50,52 (FIGS. 3 & 4) being free of extraneous material and being deformable into at least about a hollow hemispherical geometry without material disintegration thereof when incorporated into the jacket with one or more cores and with said disc being initially oriented with its planar faces 34, 36 disposed substantially normal to the longitudinal centerline 20 of the jacket.

Figure 8:
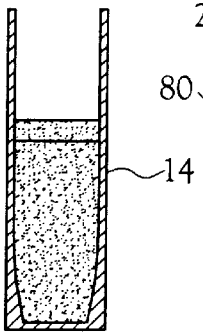
Figure 7:
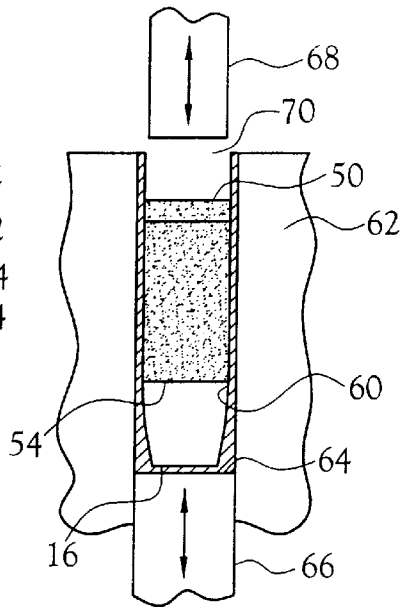
Figure 6:
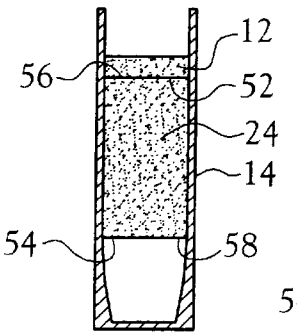

With reference to FIGS. 6–10, in one method for the manufacture of a projectile employing a single powder-based disc of the present invention, a pre-formed powder-based core 24 is inserted into the interior of a metal jacket 14. This core is of a straight cylindrical geometry having first and second opposite parallel and flat end surfaces 54,56. In the depicted method, the jacket is of a hollow cup-shaped geometry, having been formed by drawing from a flat sheet of the metal as is well known in the art. This drawing process produces a jacket having a wall thickness which varies from a maximum thickness contiguous the closed end of the jacket, to a minimum thickness at the open end of the jacket as described hereinabove. Because of this variance in the wall thickness of the jacket, and because initial alignment of the core within the jacket coincident with the longitudinal centerline of the jacket is required to ensure uniform filling of that portion of the interior volume of the jacket within which the core is intended to ultimately reside, the outer rim 58 of the first end 54 of the core engages the circumference of the jacket at that location along the length of the jacket wall where the circumference becomes substantially constant. Either simultaneously with, or subsequent to, the insertion of the core into the jacket, a powder-based disc 12 of the present invention is also inserted into the jacket with one of its flat faces 52 overlying the second end 56 of the core. As depicted in FIGS. 7 and 8, the jacket, contained the combination of core and disc is placed into the cavity 60 of a die 62. In the depicted die, one end 64 of cavity is defined and closed by a first punch 66, i.e., a knock-out punch. A second punch 68 is inserted into the opposite end 70 of the die cavity 60 to engage the outboard face 50 of the disc. Pressure applied by the second punch forces the core to deform at its first end 54 and enter and fill approximately that half of the interior volume of the jacket adjacent the closed end 16 of the jacket. The pressure applied by the second punch 68 is applied to substantially the entire outer face 50 of the disc which, in turn, transfers the pressure through the disc to the second flat face 56 of the core 24. In addition to causing the core and disc to conform to the geometry of the interior of the jacket adjacent the closed end 16 of the jacket, the core is deformed sufficiently to "lock" the disc within the jacket to hold both the disc and core against inadvertent removal or loss of the disc and/or core from the jacket. Removal of the jacket from the die is accomplished by means of the knock-out punch 66.

Figure 10:
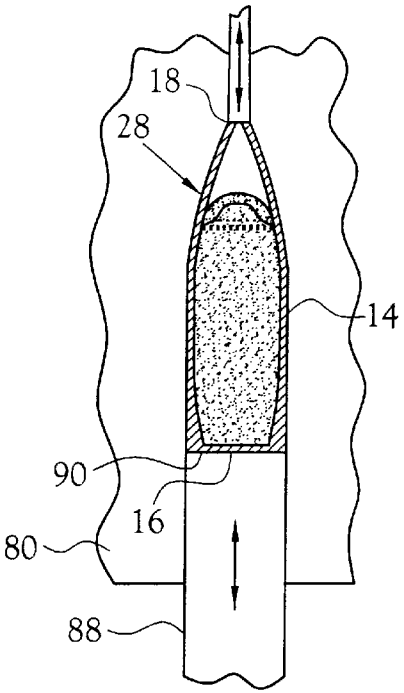
FIGS. 6–10 comprise a schematic representation of a method for the formation of a gun ammunition projectile incorporating a disc in accordance with the present invention.
Figure 9:
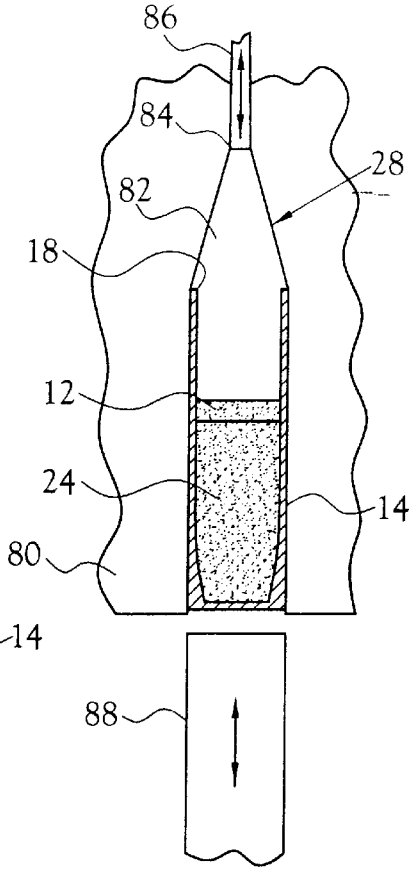

Referring to FIGS. 9 and 10, for formation of an ogive 28 on the leading open-end 18 of the jacket 24, the jacket/core/disc combination is loaded into a further die 80 having a die cavity 82 which defines the desired ogive geometry. The apex 84 of the ogive 28 geometry of the die cavity is closed by a knock-out punch 88. Once the jacket/core/disc combination is inserted into the die cavity 82 of the die 80, a further punch 88 is employed to apply pressure to the outer face 90 of the closed end 16 of the jacket, thereby urging the jacket/core/disc combination into the die cavity 82. This action causes the leading open end 18 of the jacket, the end 54 of the core 24, and the disc to be urged radially inwardly of the die cavity 82 as the jacket is swaged into conformity with the ogive geometry of the die cavity. This radial and longitudinal pressure applied to the disc and leading end of the core causes the disc to assume a generally hollow hemispherical geometry and causes the leading end of the core to flow radially and longitudinally relative to the jacket centerline. A portion of the core thus flows into the hollow hemispherical disc to fill this hollow. Notably, the flow of the core and the disc has been found to take place substantially uniformly radially and longitudinally relative to the centerline of the jacket (which is also being deformed at its open leading end). The result has been found to be a projectile which is of substantially uniform density in any given plane taken normal to the longitudinal centerline of the jacket. As noted hereinabove, the overall density of any given plane taken normal to the longitudinal centerline of the jacket may vary relative to the density of other given planes which also are taken normal to the longitudinal centerline of the jacket. This variation in density from plane to plane, however, does not adversely affect either the flight of the projectile to a target. Importantly however, this variation in the plane to plane density has been found to enhance the terminal ballistics of those projectiles which desirably are frangible when striking a solid or semi-solid target. For example, contrary to the tendency of solid discs to resist disintegration, and instead to tend to non-controllably move as a unit longitudinally of the jacket and into the core itself upon the projectile impacting a target, the present powder-based disc does not exhibit such tendencies, and in fact, has been found to enhance the desired frangibility of the projectile. Such enhancement often takes the form of more uniformity of dispersion of the franged projectile, hence more predictable terminal ballistics of the projectile, as well as enhanced uniformity of performance from projectile to projectile, hence between rounds of a given gun ammunition.

Figure 11:
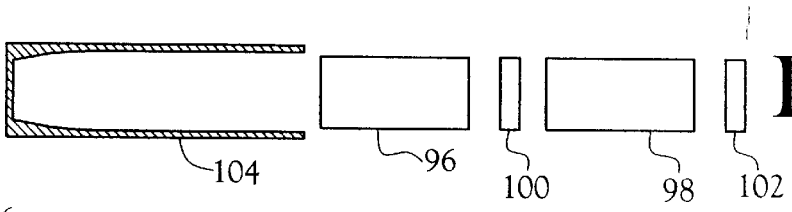
FIG. 11 is an exploded view of the components employed in the formation of a multiple-core projectile and employing two discs of the present invention.

Whereas FIGS. 6–10 depict the formation of a projectile employing a single core and a single disc, and with reference to FIG. 11, it will be noted that a like projectile may be formed employing first and second cores 96, 98, respectively and first and second discs 100, 102, respectively incorporated into a single jacket 104. The method depicted in FIGS. 6–10 may be employed to manufacture these projectiles having multiple cores and multiple discs. As desired, but not preferred, that disc 100 which is disposed between the mating faces of the first and second cores may be omitted.

Figure 12:
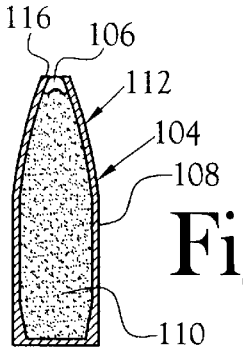
FIG. 12 is a schematic representation of a projectile as depicted in FIG. 1, but with the leading end thereof fully closed by a deformed disc.

Referring to FIG. 12, in one embodiment of a projectile including a powder-based disc 106 in accordance with the present invention, the jacket 108 may be loaded with a core 110 and disc 106 designed to cause a portion of the core plus the disc 106 to substantially fill the interior volume of the jacket when the jacket/core/disc combination is die formed to provide an ogive 112 on the leading end of the jacket. In this instance, the disc 106 may be positioned to substantially close the open end 116 of the jacket as depicted in FIG. 12. This embodiment provides a projectile 104 wherein the terminal ballistics of the projectile are altered to cause the jacket to disintegrate less readily than if there is an open cavity left within the leading end of the jacket as is depicted in the projectile of FIG. 1. Such a projectile, for example, can be made to penetrate a target a greater distance before fully disintegrating.

Employing the concepts of the present invention, one is provided with the option of choosing from a great range of diameters and thicknesses of the disc through selection of the diameter of the die cavity employed in pressing the disc from its base powder. Likewise, the density of the disc, hence its contribution to the terminal ballistics of the projectile, may be selected through choice of the amount of powder which is pressed into a given size disc employing a given pressing pressure. Further, different thickness of discs may be employed. Accordingly, the present invention represents considerable savings in time and cost for the manufacture of a given projectile, as well as cost savings over the time-consuming and relatively costly pretreatment required for the solid discs of the prior art. Also as noted, the uniformity of deformation of the present discs is improved over the prior art metal discs, thereby yielding a projectile which can be delivered more accurately and which can be manufactured with consistent performance characteristics from round to round of the gun ammunition.

Figure 14:
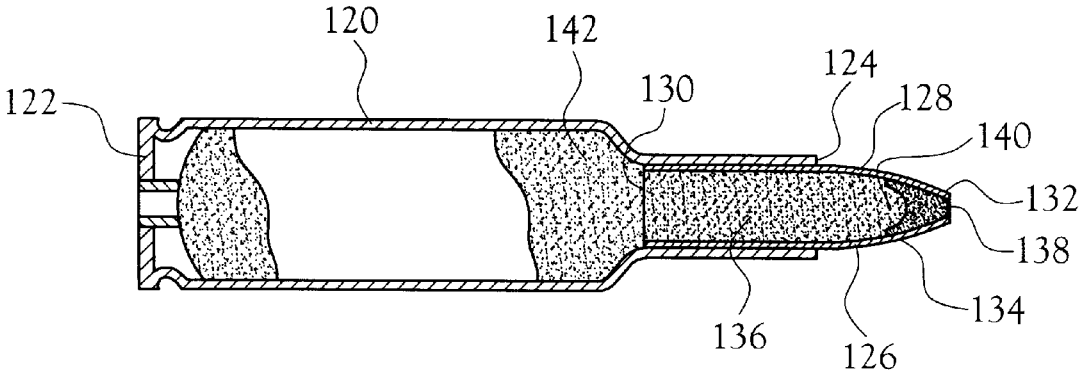
Figure 15:
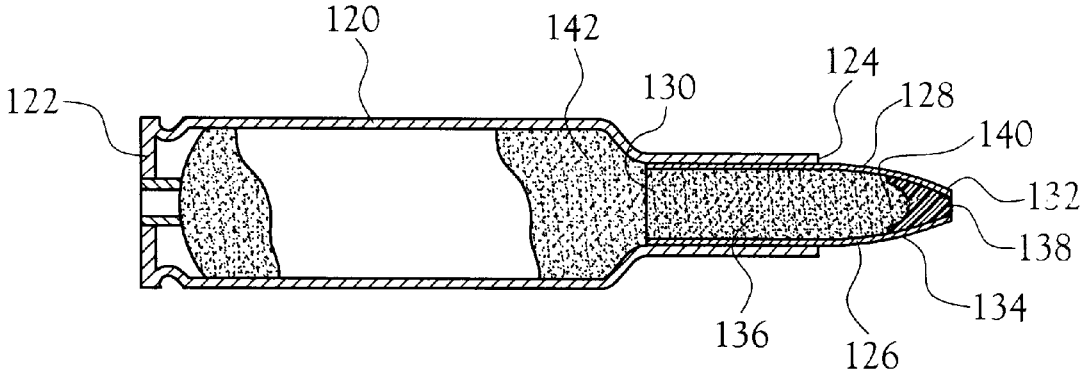

With reference to FIG. 14, one embodiment of a round of gun ammunition which incorporates therein a powder-based disc of the present invention includes a case 120 having a trailing end 122 and an open leading end 124. A projectile 126 is disposed within the open end 124 of the case. The depicted projectile includes a jacket 128 having a closed trailing end 130 and a leading end 132 which defines an ogive 134. The interior volume of the jacket is filled with a compressed core 136 of a mixture of metal powders, such as tungsten and tin metal powders and a deformed disc 138. In the manufacture of the projectile, the disc was planar, disposed within the jacket and extended diametrically of the jacket. Upon formation of the ogive 134, the disc is squeezed toward the leading end of the jacket and is deformed into a generally hollow hemispherical geometry. As depicted, the hollow 140 of the deformed disc is filled with metal powders from the core. In the depicted embodiment, the disc effectively closes the leading end of the projectile. Gun powder 142 is loaded into the case prior to the placement of the projectile in the leading end of the case. As desired, the volume of the core and the disc may be chosen such that there remains an unfilled portion of the jacket adjacent its leading end 132, i.e., hollow point projectile.

Whereas the present invention has been described in conformity with the best mode presently known to the inventor, it will be recognized by a person skilled in the art that modifications in the invention may be made without deviating from the invention as set forth in the claims appended hereto. For example, whereas the jacket described in the present disclosure possesses a wall thickness which varies from its closed end toward its open end, it will be recognized that a straight-wall jacket which has a uniform wall thickness from its closed end to its open end may be employed. Moreover, one skilled in the art will recognize that in certain projectiles, polymeric jackets may be employed. Further, cores formed from tungsten, lead, and/or other metals or alloys, or mixtures thereof are known in the art and may be employed in combination with the discs of the present invention. Still further, the disc of the present invention may be formed from material other than tin, such as iron, lead, aluminum, zinc, magnesium, bismuth, copper or alloys or mixtures thereof or a powdered polymeric material. If desired, the pressed powder-based disc of the present invention may be sintered to impart even less frangibility to the disc upon the projectile striking a target. Such sintering, however, is not to be such as will destroy the flowability of the powder particles of the disc, hence the deformability of the disc, when the disc is deformed in the course of incorporating the disc into a projectile.

What is claimed:

1. A method for the manufacture of a projectile for gun ammunition of 50 caliber or less employing a projectile which includes at least one core of pressed powder housed within a cup-shaped jacket having a closed end, an initially open opposite end, and a longitudinal centerline comprising the steps of disposing within the jacket a powder-based core, thereafter, disposing within the jacket in juxtaposition to the core, a powder based disc, said disc comprising a compressed compact having opposite planar faces and pressure-formed from a powder or mixture of powders into a substantially self-supporting compact of substantially uniform thickness and substantially uniform density throughout the compact, said compact being of substantially right cylindrical geometry with its perimetral edges being free of extraneous material and being deformable when incorporated into the jacket with one or more cores and with said disc being initially oriented with its planar faces disposed substantially normal to the longitudinal centerline of the jacket, pressing said core and disc simultaneously into conforming fit within a portion of the interior volume of the jacket, thereafter, die-forming an ogive at the open end of the jacket by forcing the open end of the jacket into a die cavity which defines the desired geometry of the ogive, the force applied to the jacket being sufficient to deform the open end of the jacket, along with the disc and at least a portion of that end of the core juxtaposed to the disc, into conformity with the volume of the die cavity, and to deform said disc into a generally hollow hemispherical geometry within the ogive and substantially filling said hollow with powder from said core.

2. The method of claim 1 and including the step of die-forming a boattail on that end of the projectile opposite the ogive.

3. The method of claim 1 wherein said step of forming said disc includes deforming said disc and the core to the extent that said disc substantially fills and closes the open end of the jacket.

4. A round of gun ammunition including a frangible projectile embodying a cup-shaped jacket having a closed end and an opposite and defining an ogive and a powder-based core contained within the jacket comprising a powder-based disc disposed within the jacket within the ogive, said disc being of a generally hollow hemispherical geometry and containing powder from the core disposed within the hollow thereof, said disc incompletely filling said opposite end of said jacket.

5. The round of gun ammunition of claim 4 and including multiple cores aligned in tandem with the jacket and at least one further powder-based disc disposed between adjacent ones of said cores.

6. The round of ammunition of claim 4 wherein said disc is formed by pressing of a mixture of metal powders in a die at room temperature to a pressure sufficient to develop a disc which is self-supporting.

7. The round of ammunition of claim 4 wherein the ogive of the projectile does not fully closed the opposite end of the jacket and said disc effectively closes the opposite end of the jacket.

8. The round of gun ammunition of claim 4 wherein said powder based disc is either tin, iron, magnesium, aluminum, copper, zinc, bismuth, lead or a mixture of two or more of these metal powders.

9. The round of gun ammunition of claim 4 wherein said powder based disc is a polymeric material.

10. The round of gun ammunition of claim 4 wherein said powder based disc comprises a blend of particle sizes of said powder.

11. The round of gun ammunition of claim 10 wherein said powder exhibits a particle size distribution comprising at least 60% of the particles thereof being between about 200 mesh and about 325 mesh.

12. The round of gun ammunition of claim 10 wherein said powder further includes at least about 20% of the particles thereof of less than about 325 mesh.

13. The round of gun ammunition of claim 4 wherein said powder based disc is pressed in a die cavity of right cylindrical geometry at a pressure of between about 12,000 psi and about 16,000 psi into a self-supporting compact.

14. The round of gun ammunition of claim 4 wherein said powder based disc is tin powder.

15. The round of gun ammunition of claim 14 wherein said tin powder is substantially free of surface oxidation.

* * * * *